US011447291B2

(12) United States Patent
Banik

(10) Patent No.: US 11,447,291 B2
(45) Date of Patent: Sep. 20, 2022

(54) UNIVERSAL TOP CAP

(71) Applicant: ORBIS Corporation, Oconomowoc, WI (US)

(72) Inventor: Joachim Banik, Oconomowoc, WI (US)

(73) Assignee: ORBIS Corporation, Oconomowoc, WI (US)

( * ) Notice: Subject to any disclaimer, the term of this patent is extended or adjusted under 35 U.S.C. 154(b) by 0 days.

(21) Appl. No.: 17/188,410

(22) Filed: Mar. 1, 2021

(65) Prior Publication Data

US 2021/0276761 A1 Sep. 9, 2021

Related U.S. Application Data

(60) Provisional application No. 62/987,061, filed on Mar. 9, 2020.

(51) Int. Cl.
*B65D 19/38* (2006.01)

(52) U.S. Cl.
CPC .. *B65D 19/385* (2013.01); *B65D 2519/00318* (2013.01); *B65D 2519/00338* (2013.01); *B65D 2519/00965* (2013.01)

(58) Field of Classification Search
CPC ..... B65D 19/385; B65D 2519/00935; B65D 2519/00955; B65D 2519/0096; B65D 2519/00965; B65D 2519/0097
USPC ..... 108/51.11, 53.1, 53.3
See application file for complete search history.

(56) References Cited

U.S. PATENT DOCUMENTS

| | | | | |
|---|---|---|---|---|
| D35,174 S | | 10/1901 | Conklin | |
| 2,704,600 A | * | 3/1955 | Despres | B65D 71/70 206/392 |
| 3,375,919 A | | 4/1968 | Schlager et al. | |
| 3,526,195 A | * | 9/1970 | Maryonovich | B65D 19/004 108/53.1 |
| 3,628,468 A | * | 12/1971 | Angelbeck, Jr. | B65D 19/44 108/53.1 |
| 3,636,888 A | * | 1/1972 | Angelbeck, Jr. | B65D 19/0014 108/53.1 |
| 3,926,321 A | * | 12/1975 | Trebilcock | B65D 71/70 206/446 |
| 3,944,070 A | * | 3/1976 | Cardwell | B65D 19/004 206/596 |

(Continued)

FOREIGN PATENT DOCUMENTS

| | | |
|---|---|---|
| CA | 2656668 C | 9/2016 |
| CA | 3075535 A1 | 9/2020 |

(Continued)

OTHER PUBLICATIONS

European Patent Office, Extended European Search Report from EP 21161370.8, dated Aug. 9, 2021, 9 pages Aug. 9, 2021.

*Primary Examiner* — Jose V Chen
(74) *Attorney, Agent, or Firm* — Greensfelder, Hemker & Gale, P.C.; Richard C. Himelhoch

(57) ABSTRACT

The invention is directed to a universal top cap having structure for securely mating with and supporting a pallet, or a steel mesh container or a collapsible container. The top cap includes an upper support surface having an upwardly extending lip structure along a perimeter of the upper surface. The upper surface is also provided with recesses and protrusions which enable the top cap to mate with the various items.

12 Claims, 9 Drawing Sheets

(56) References Cited

U.S. PATENT DOCUMENTS 3,962,660 A * 6/1976 Duckett ..... H01F 27/002 336/65
3,993,168 A * 11/1976 Kubick ..... B65D 19/0034 108/53.1
3,995,749 A * 12/1976 Haskins ..... B65D 19/0014 206/599
4,000,704 A * 1/1977 Griffin, Jr. ..... B65D 19/004 108/53.1
4,183,491 A * 1/1980 Sanders ..... B65D 19/0024 108/53.3
4,226,192 A * 10/1980 Myers ..... B65D 19/0018 108/53.1
4,413,737 A 11/1983 Wind
4,478,156 A * 10/1984 Andersson ..... B65D 19/04 108/53.1
4,480,748 A * 11/1984 Wind ..... B65D 19/0018 108/55.3
4,516,677 A * 5/1985 Rowland ..... B65D 71/70 108/53.1
4,580,680 A * 4/1986 Wind ..... B65D 19/0018 108/55.3
4,643,314 A 2/1987 Kidd
D288,978 S 3/1987 Wind
4,735,321 A 4/1988 Day
4,799,433 A 1/1989 Luft
4,801,024 A * 1/1989 Flum ..... A47F 7/281 108/53.1
4,865,202 A * 9/1989 Day ..... B65D 19/0018 206/597
5,011,011 A * 4/1991 Kidd ..... B65D 1/36 206/319
5,052,307 A * 10/1991 Morrison ..... B65D 19/38 108/53.1
5,080,023 A 1/1992 Miura et al.
5,088,418 A * 2/1992 Reckermann ..... B65D 19/44 108/57.25
5,109,985 A * 5/1992 Rose ..... B65D 19/06 206/600
5,144,897 A * 9/1992 Avery ..... B65D 71/0096 108/55.3
5,205,410 A * 4/1993 Kuipers ..... B65D 57/003 206/386
5,390,789 A 2/1995 Darby
D356,200 S 3/1995 Kem et al.
5,527,585 A * 6/1996 Needham ..... B65D 19/0028 428/156
5,547,081 A 8/1996 Mullock et al.
5,755,162 A * 5/1998 Knight ..... B65D 19/0012 108/53.1
5,829,364 A 11/1998 Urbach
D403,829 S 1/1999 Apps et al.
D404,180 S * 1/1999 Apps ..... D34/38
5,960,720 A * 10/1999 Borland ..... B65D 19/0018 108/53.1
D429,052 S 8/2000 Ito et al.
D434,509 S 11/2000 Oliver et al.
6,170,689 B1 * 1/2001 Flesher ..... B65D 19/06 206/508
6,209,464 B1 4/2001 Elder
D445,554 S * 7/2001 Blason ..... D34/38
D445,900 S 8/2001 Koefelda et al.
D459,049 S 6/2002 Apps et al.
D459,050 S 6/2002 Meyer
D464,186 S 10/2002 Medoff et al.
6,718,887 B1 * 4/2004 Cook, Sr. ..... B65D 19/38 108/53.1
D489,860 S 5/2004 Apps et al.
6,910,668 B2 6/2005 Henning
D508,300 S 8/2005 O'Dell et al.
D544,675 S 6/2007 Ishikawa et al.
D548,924 S 8/2007 Frankenberg
D550,925 S 9/2007 Boaler et al.
D595,024 S 6/2009 Banik
8,505,468 B2 * 8/2013 Yoshizawa ..... H01L 21/67346 108/53.1
9,296,515 B2 3/2016 Banik
9,688,437 B1 * 6/2017 Dimer ..... B65D 85/68
2002/0195452 A1 12/2002 Apps
2003/0089285 A1 * 5/2003 Carson ..... B65D 19/0018 108/57.28
2004/0238400 A1 * 12/2004 Knutsson ..... B65D 19/18 206/600
2006/0272556 A1 * 12/2006 Apps ..... B65D 19/44 108/53.1
2009/0127158 A1 5/2009 Apps
2009/0218244 A1 * 9/2009 Banik ..... B65D 19/38 206/386
2009/0241461 A1 * 10/2009 Linares ..... B65D 19/004 52/592.1
2012/0291677 A1 * 11/2012 Lin ..... B65D 19/0038 108/53.3
2013/0277263 A1 * 10/2013 Jung ..... B65D 71/04 206/459.5
2014/0345500 A1 * 11/2014 Dunn ..... B65D 19/0028 108/53.3
2015/0175304 A1 6/2015 Ficker
2015/0203138 A1 * 7/2015 Hassell ..... B62B 3/008 280/47.34
2019/0055057 A1 * 2/2019 Wood ..... B65D 19/0018
2019/0127115 A1 5/2019 Hassell et al.
2019/0241358 A1 8/2019 Omre et al.
2019/0359382 A1 11/2019 Frankenberg
2020/0290767 A1 9/2020 Thompson
2021/0261292 A1 * 8/2021 Lopez Uran ..... B65D 19/44

FOREIGN PATENT DOCUMENTS

DE 202018104281 U1 12/2018
EP 2868592 A1 5/2015
EP 3878765 A1 9/2021
MX 2009002190 A 9/2009

* cited by examiner

UNIVERSAL TOP CAP

CROSS-REFERENCE TO RELATED APPLICATIONS

The present invention claims priority to and the benefit of U.S. Provisional Patent Application No. 62/987,061 filed Mar. 9, 2020, the contents of which are incorporated herein by reference and made a part hereof.

FEDERALLY SPONSORED RESEARCH OR DEVELOPMENT

N/A

FIELD OF THE INVENTION

The present invention is directed to a top cap used for a bin that includes structure to hold a pallet, a steel mesh container or a collapsible plastic container placed on top of the top cap.

DESCRIPTION OF THE PRIOR ART

Some known top caps are designed to enable other transportation systems (i.e., a system for transporting goods, such as pallets, bins, containers, etc.) to securely stack on top of the top cap. That is, the top cap has structure that mates with or otherwise supports the bottom features or footprint of the other transportation system.

One such top cap has an upper surface designed to hold either a European style pallet or a particular steel mesh container. The pallet has three runners extending along a bottom portion of the pallet. The steel mesh container has four corner feet. The top cap was limited to these two transportation system.

The present invention provides an improved to top cap having an upper surface for holding a pallet, a steel mesh container, and a collapsible container.

SUMMARY OF THE INVENTION

The present invention is directed to a universal top cap configured to hold a pallet, a steel mesh container and a collapsible container. The pallet can be a European standard DIN EN 13698-1 ("EPAL" or "Europallet"), and the steel mesh container can be a DIN 15115. The collapsible container can be formed from plastic.

In accordance with one aspect of the invention, a top cap for holding other transportation systems is provided. The top cap comprises an upper surface having a generally rectangular outer perimeter. The upper surface includes structure for supporting a pallet, structure for supporting a steel mesh container and structure for supporting a collapsible container.

The structure for supporting a pallet and the structure for supporting the steel mesh container can comprises an upper lip structure extending upward from the perimeter of the top cap. In one instance, the upper lip structure includes a first portion extending upward from a first corner of the upper support surface, a second portion extending upward from a second corner of the upper support surface, a third portion extending upward from a third corner of the upper support surface, and a fourth portion extending upward from a fourth corner of the upper support surface.

The structure for supporting the pallet and the structure for supporting a steel mesh container can also comprise a plurality of protrusions extending upward from the upper support surface. Each of the plurality of protrusions can have a generally cylindrical shape.

The structure for supporting a collapsible container can comprise a plurality of recesses to hold runners of the collapsible container. The plurality of recesses can include a first recess proximate a first side of the upper surface, a second recess proximate a second side of the upper surface and a third recess proximate a middle portion of the upper surface.

The top cap can include a lower lip structure extending downward from the perimeter of the top cap. The top cap can also include a plurality of ribs extending downward from a lower surface of the top cap opposing the upper support surface. The lower lip structure can also include a first notch and a second notch spaced from the first notch along a first side of the top cap and a first notch and a second notch spaced from the first notch along a second side of the top cap. The notches facilitate use of a first and second fork tine to lift a stack of the top caps.

The upper surface of the top cap can include a first raised portion between the first recess and the third recess, and a second raised portion between the second recess and the third recess. The first raised portion and the second raised portion can include channels for matting with lower structure of another transport system.

Each of the first recess, second recess and third recess can includes at least one of the plurality of protrusions. Each of the first recess, second recess and third recess can include a first protrusion and a second protrusion proximate a first end of the upper support surface. Similarly, each of the first recess, second recess and third recess can include a third protrusion and a fourth protrusion proximate a second end of the upper support surface. Each of the first recess, second recess and third recess can also include a fifth protrusion proximate a middle portion of the upper support surface.

The top cap can further include a plurality of angled segments along the perimeter of the upper support surface. The angle segments can be used to accommodate straps used to secure the top cap to a container and/or pallet etc.

The upper lip structure can have a double wall construction. This provides extra strength in this area which will help prevent any transportation system using this structure from slipping off the top cap.

The top cap is preferably formed from plastic.

Other features and advantages of the invention will be apparent from the following specification taken in conjunction with the following Figures and Attachments.

BRIEF DESCRIPTION OF THE DRAWINGS

To understand the present invention, it will now be described by way of example, with reference to the accompanying drawings in which.

DETAILED DESCRIPTION

Figure 1:
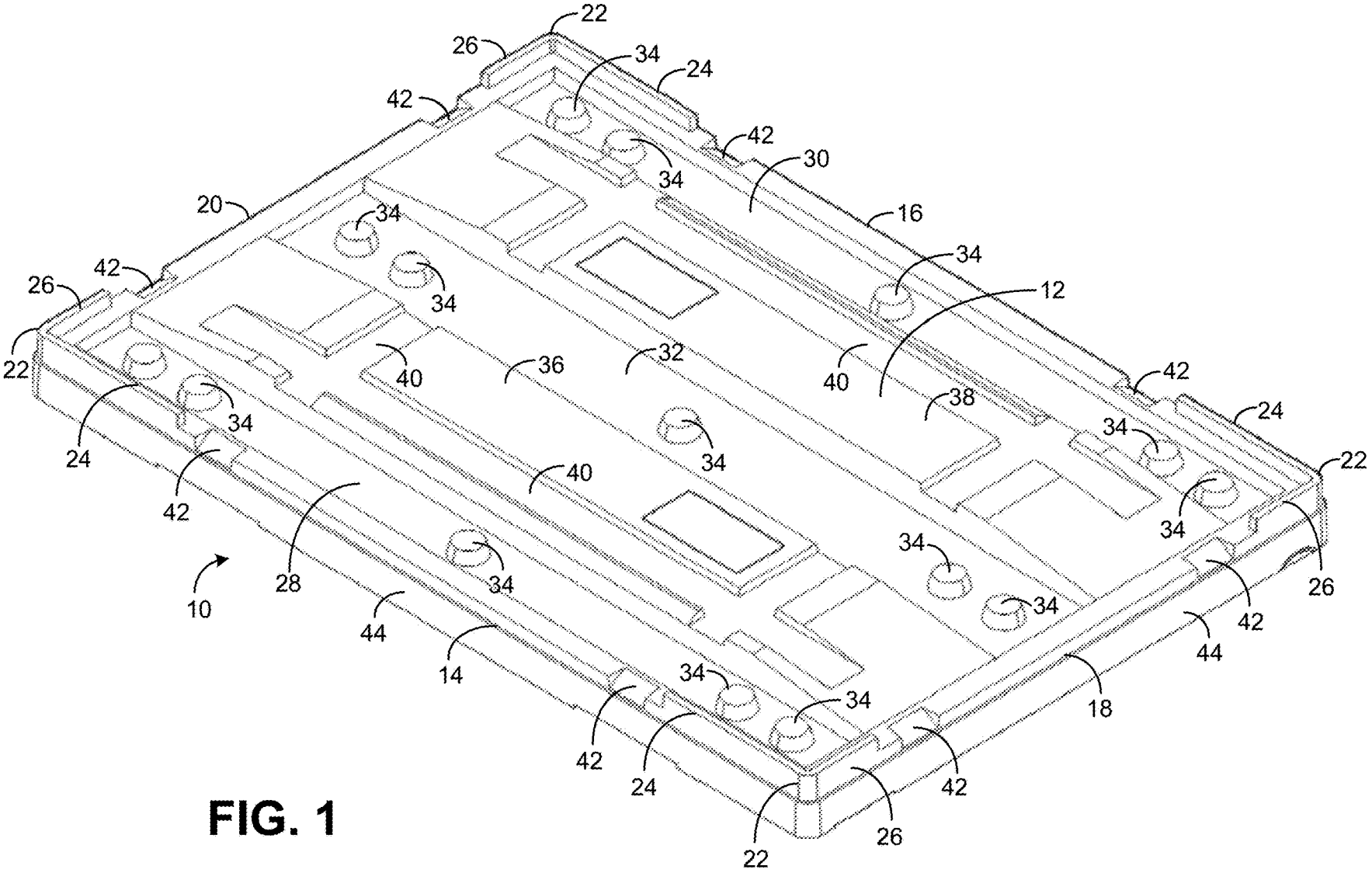
FIG. 1 is a perspective view of a top cap in accordance with the present invention.
Figure 2:
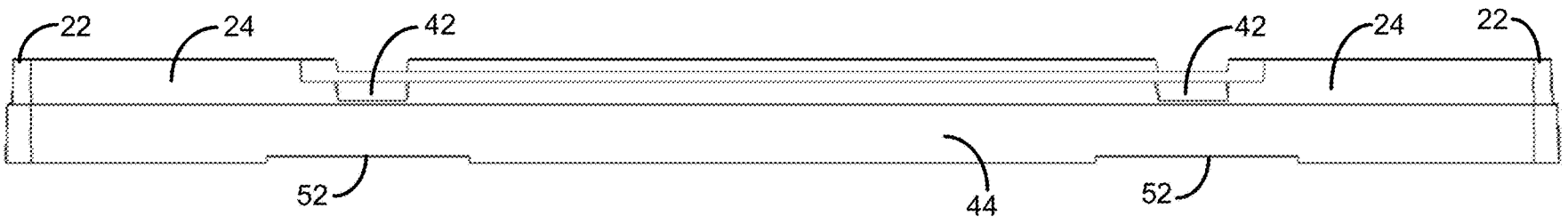
FIG. 2 is a side view of the top cap of FIG. 1.
Figure 3:
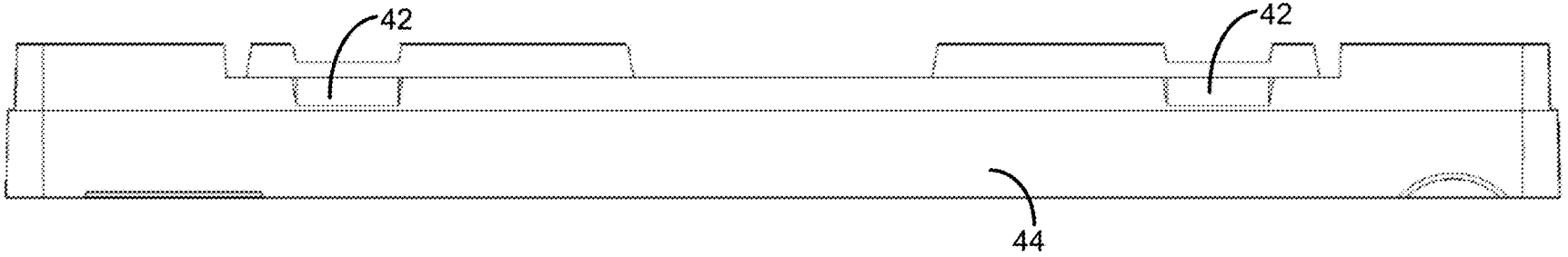
FIG. 3 is an end view of the top cap of FIG. 1.
Figure 4:
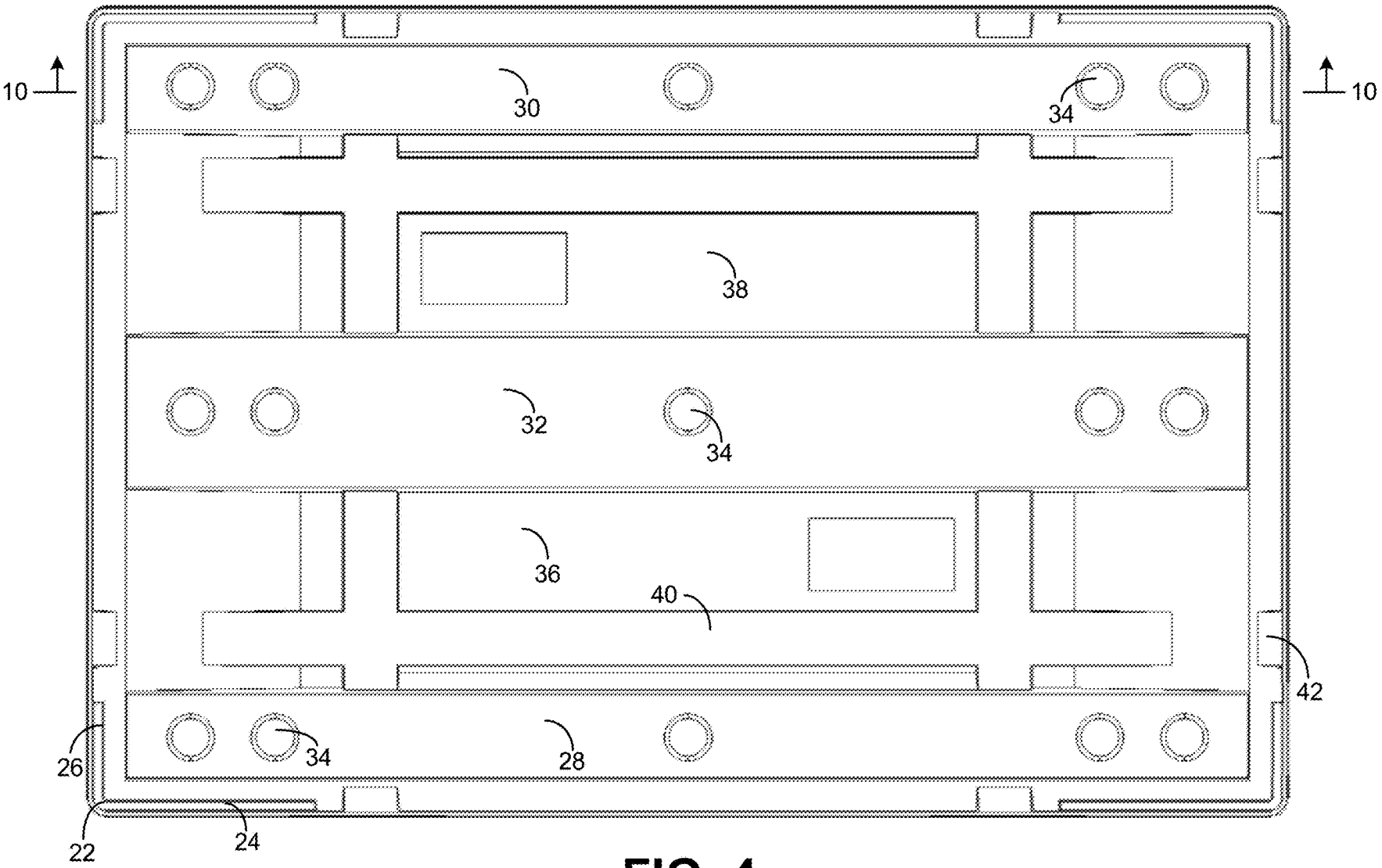
FIG. 4 is a top plan view of the top cap of FIG. 1.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

A top cap 10 in accordance with the present invention is shown in FIGS. 1-5. The top cap 10 has a generally rectangular outer perimeter surrounding an upper support surface 12. The upper surface 12 includes a first side 14, an opposing second side 16, a first end 18 and an opposing second end 20.

The support surface includes structure designed to mate with the bottom structure of a variety of other transportation systems (i.e., systems for transporting goods such as pallets, bins, containers, etc.) to enable such systems to securely stack on the upper surface 12 of the top cap 10.

The structure in the upper support surface 12 includes a plurality of raised lip portions 22 extending upward from the perimeter of the upper surface 12. The lip portions 22 are in each of the four corners of the upper support surface 12. Each lip portion 22 includes a segment 24 extending along one of the sides 14, 16 of the upper surface 12, and a segment 26 extending along on of the ends 18, 20 of the upper surface 12.

The upper surface 12 includes a first recess 28 proximate the first side 14, a second recess 30 proximate the second side 16, and a third recess 32 in a mid-portion of the upper surface 12. Each of the recesses 28, 30, 32 includes a plurality of upwardly extending protrusions 34—two of which are proximate each of the ends 18, 20 and one in the middle of each recess 28, 30, 32. Each of the protrusions 34 has a generally cylindrical (or slightly conical) outer surface shape with a flat upper surface.

The upper surface 12 of the top cap 10 also includes a first raised portion 36 between the first recess 28 and the third recess 32, and a second raised portion 38 between the second recess 30 and the third recess 32. Each of the raised portions 36, 38 includes channels 40 depressed therein. The channels 40 can be used to support all or a portion of the bottom structure of a transport system.

The perimeter of the upper surface 12 also includes a number of angled segments or grooves 42 along the first and second sides 14, 16, and the first and second ends 18, 20. The angled segments 42 are sized to accommodate straps used to hold the top cap 10 to a container or other transport system.

Figure 6:
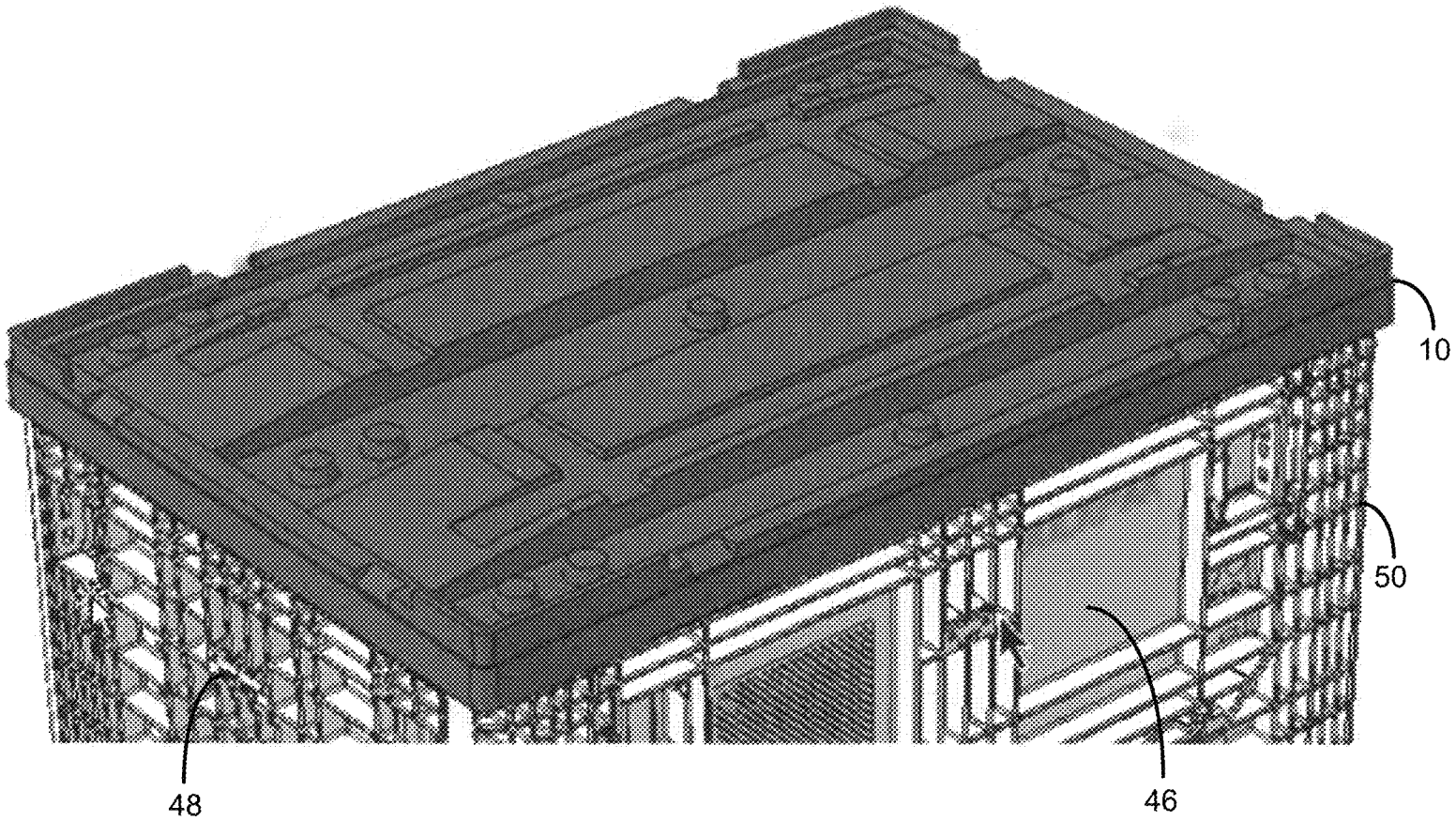
FIG. 6 is a perspective view of the top cap of the present invention on a container.

The top cap 10 also includes a lower lip structure 44 extending downward from the perimeter of the upper surface 12. The lower lip structure 44 extends over the top portions of the side walls 46 and end walls 48 of a container 50 as illustrated in FIG. 6. As more clearly seen in FIG. 2, the lower lip structure 44 includes notches 52 along the sides of the top cap 10. These notches 52 facilitate placement of the top cap 10 on fork tines. This makes transporting stacks of top caps 10 easier.

Figure 5:
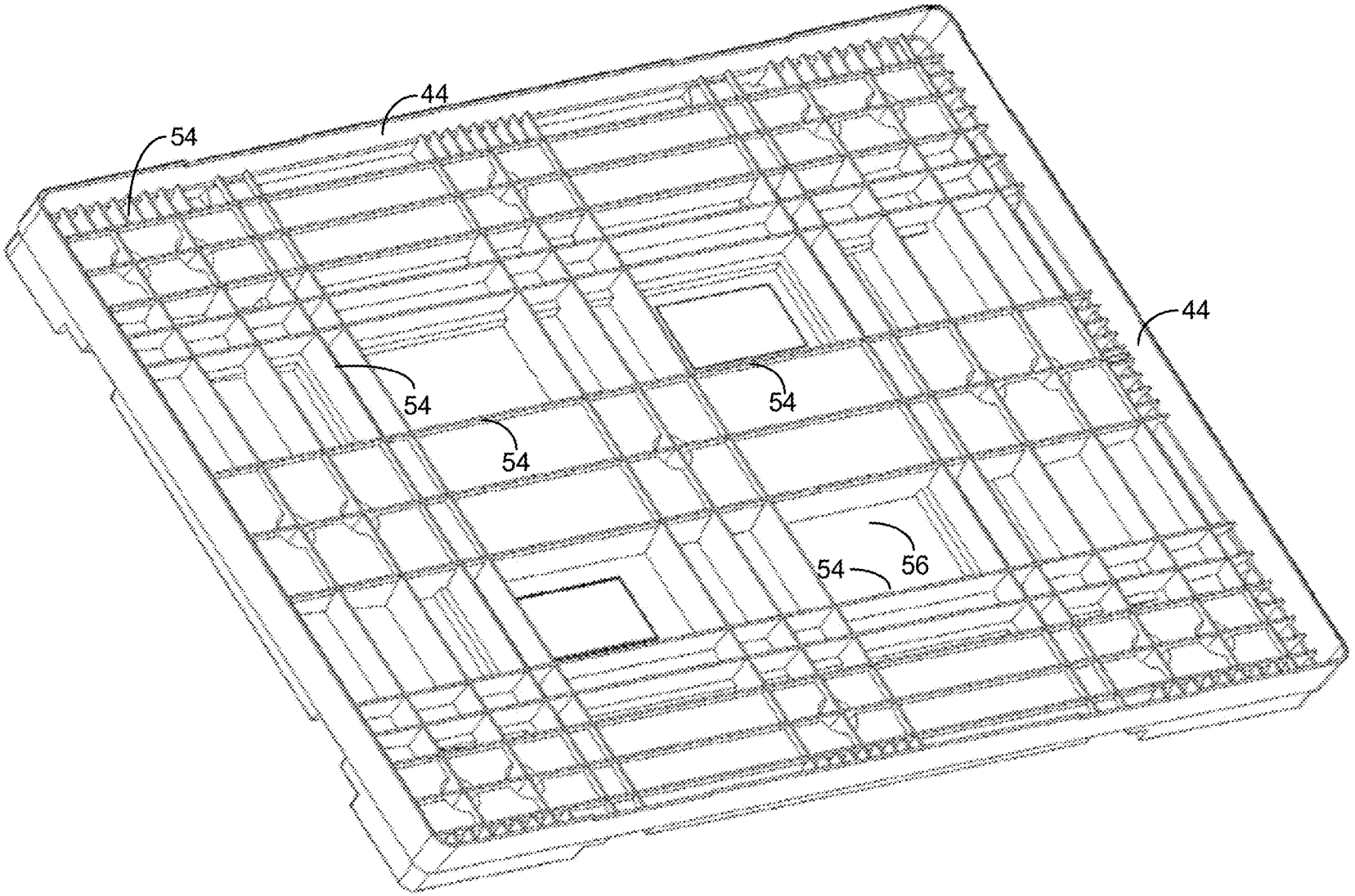
FIG. 5 is an elevational view of the bottom of the top cap of FIG. 1.

As illustrated in FIG. 5, the top cap 10 includes a plurality of ribs 54 extending downward from a lower surface 56 of the upper support surface 12. The ribs 54 provide strength and rigidity to the top cap 10.

Referring to FIGS. 6-9, when the top cap 10 is positioned on the top of a transport system, such as the container 50, it can be used to securely mate with and support a number of other transport systems placed on the container 50. Specifically, the top cap 10 is configured to support any of a pallet, a mesh steel container and a collapsible container.

Figure 7:
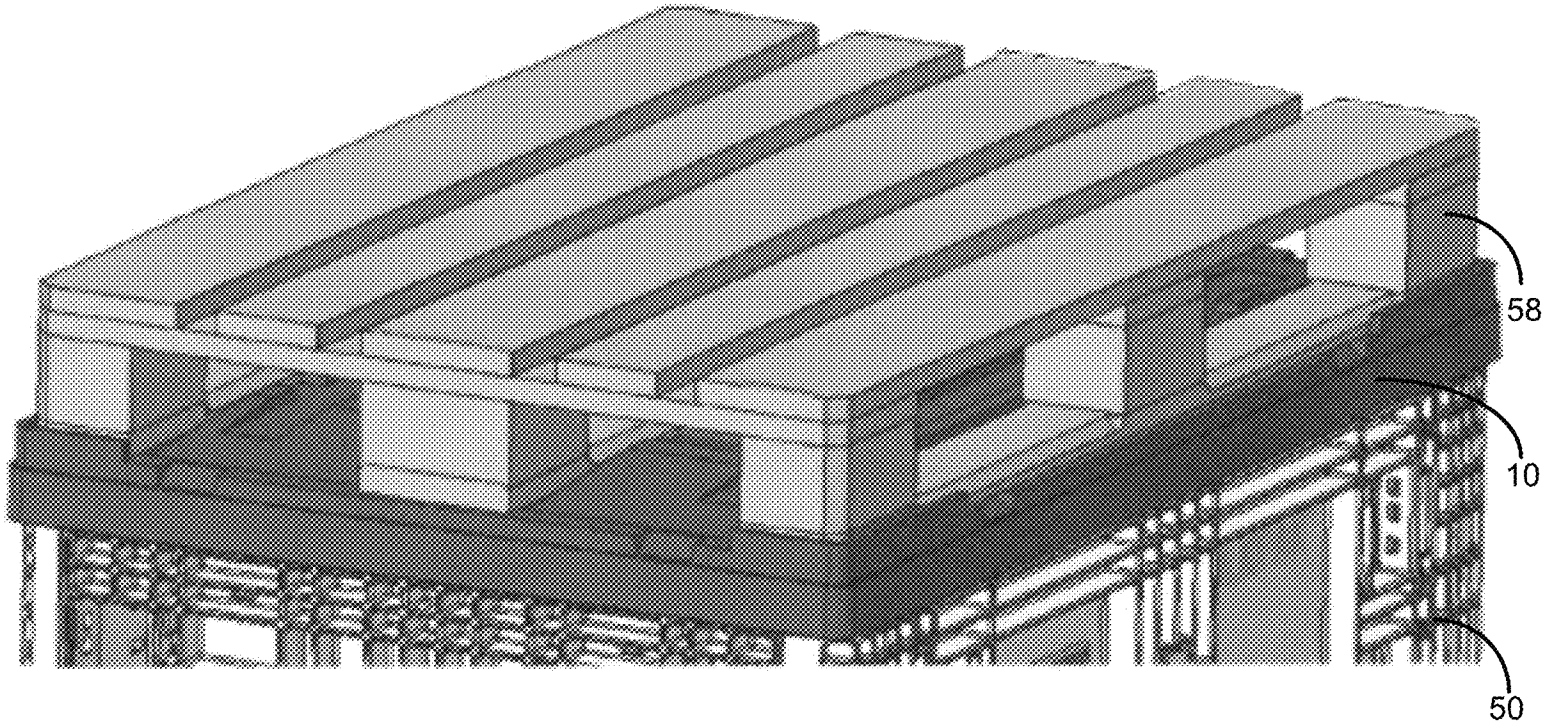
FIG. 7 is a partial perspective view of the top cap of the present invention supporting a pallet.
Figure 8:
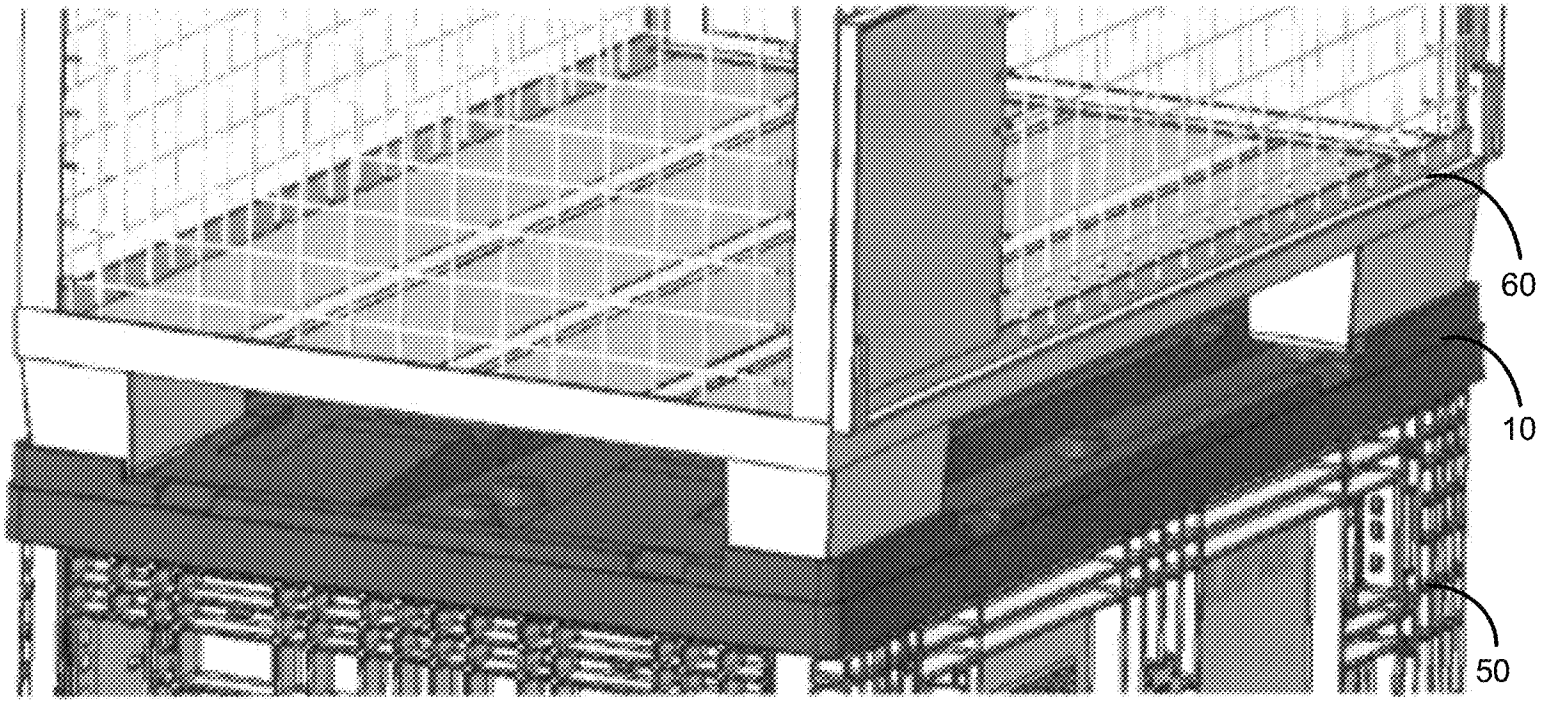
FIG. 8 is a partial perspective view of the top cap of the present invention supporting a steel mesh container.
Figure 9:
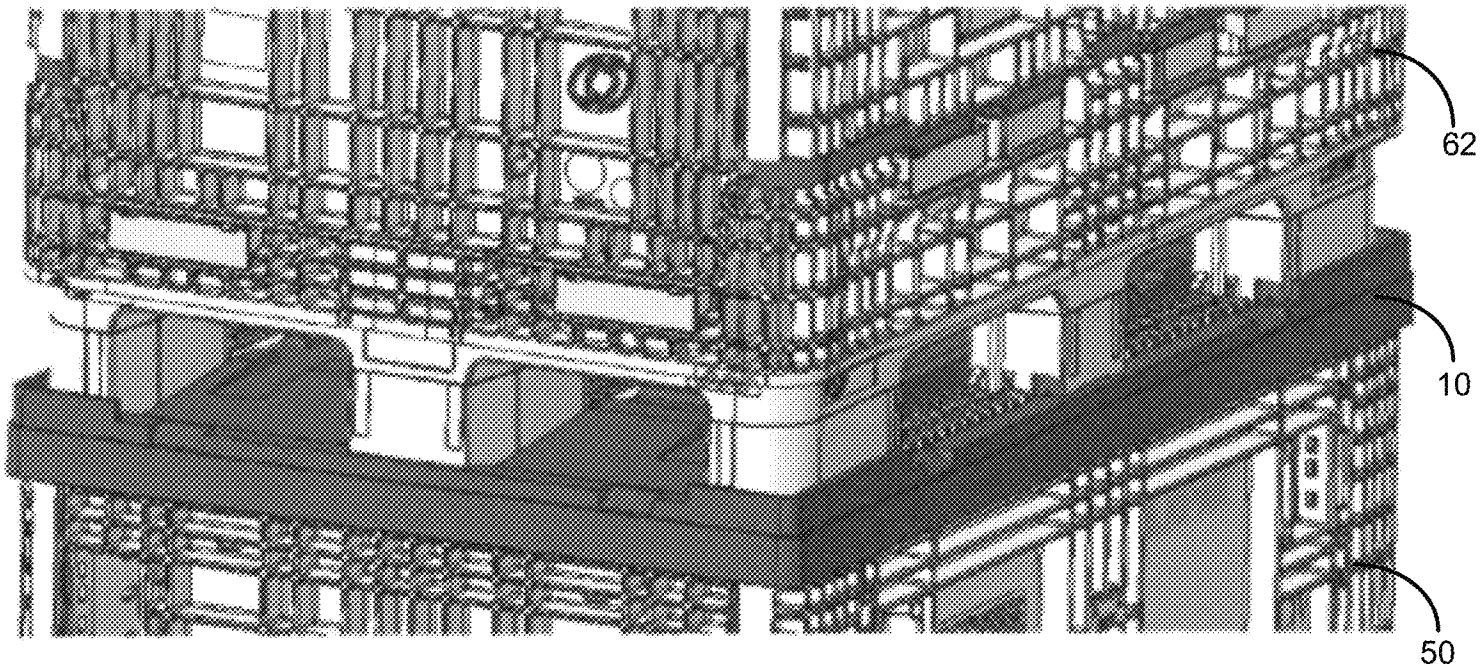
FIG. 9 is a partial perspective view of the top cap of the present invention supporting a collapsible container; and, FIG. 10 is a cross-sectional view of the top cap of FIG. 1 along the line 10-10 in FIG. 4.

FIG. 7 shows the container 50 and top cap 10 with a pallet 58 stacked on top of the top cap 10. FIG. 8 shows a steel mesh container 60 stacked on top of the top cap 10, and FIG. 9 shows a collapsible container 62 (which can be similar or identical to the container 50 on which the top cap 10 rests) stacked on the top cap 10. In each instance, placement of the upwardly extending lip structure 22 in the four corners prevents any of the transport systems from sliding off the top cap 10.

Figure 10:
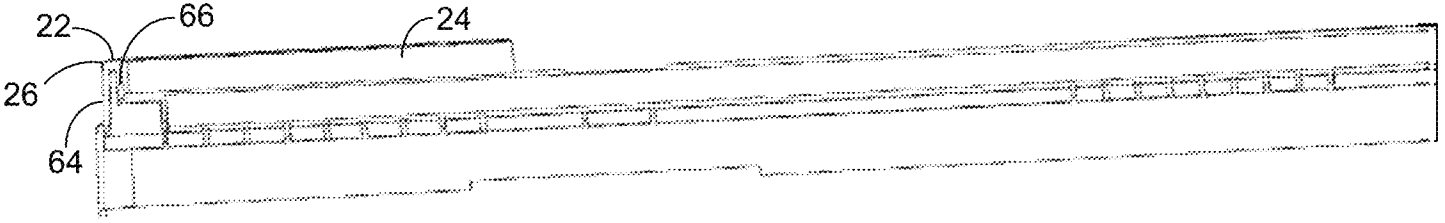

As illustrated in the cross-sectional view of FIG. 10, the upwardly extending lip structure 22 has a double wall construction. As shown, the lip segment 26 has an outer wall 64 and an inner wall 66 connected to the outer wall 64 at a top edge.

Many modifications and variations of the present invention are possible in light of the above teachings. It is, therefore, to be understood within the scope of the appended claims the invention may be protected otherwise than as specifically described.

I claim:

1. A top cap comprising:

an upper support surface having a generally rectangular outer perimeter, a first side, a second side opposing the first side, a first end and a second end opposing the first end, the upper support surface including:

a first structure configured to be able to support a pallet, the first structure including a first rectangular recess proximate the first side and extending from the first end to the second end, a second rectangular recess proximate the second side and extending from the first end to the second end, and a third rectangular recess between the first recess and the second recess and extending from the first side to the second side;

a second structure configured to be able to support a steel mesh container; and a third structure configured to be able to support a collapsible container having a plurality of feet, the third structure including an upwardly extending protrusion proximate a middle portion of the first recess, and an upward extending protraction proximate a middle portion of the second recess, wherein the structure for supporting the pallet and the structure for supporting a steel mesh container comprises an upwardly extending protrusion in the first recess proximate the first corner of the upper support surface, an upwardly extending protrusion in the first recess proximate the second corner of the upper support surface, an upwardly extending protrusion in the second recess proximate the third corner of the upper support surface, and an upwardly extending protrusion in the second recess proximate the fourth corner of the upper support surface.

2. The top cap of claim 1 wherein each of the plurality of protrusions has a generally cylindrical shape.

3. The top cap of claim 1 further comprising a plurality of angled segments along the perimeter of the upper support surface for accommodating straps used to secure the top cap to a container.

4. The top cap of claim 1 wherein each of the first recess, second recess and third recess include a first protrusion and a second protrusion proximate a first end of the upper support surface.

5. The top cap of claim 4 wherein each of the first recess, second recess and third recess include a third protrusion and a fourth protrusion proximate a second end of the upper support surface.

6. The top cap of claim 5 wherein each of the first recess, second recess and third recess include a fifth protrusion proximate a middle portion of the upper support surface.

7. The top cap of claim 1 wherein the top cap is formed from plastic.

8. A top cap of claim 1 comprising:

an upper support surface having a generally rectangular outer perimeter, a first side, a second side opposing the first side, a first end and a second end opposing the first end, the upper support surface including:

a first structure configured to be able to support a pallet, the first structure including a first rectangular recess proximate the first side and extending from the first end to the second end, a second rectangular recess proximate the second side and extending from the first end to the second end, and a third rectangular recess between the first recess and the second recess and extending from the first side to the second side;

a second structure configured to be able to support a steel mesh container; and a third structure configured to be able to support a collapsible container having a plurality of feet, the third structure including an upwardly extending protrusion proximate a middle portion of the first recess, and an upward extending protraction proximate a middle portion of the second recess, wherein the top cap includes a lower lip structure extending downward from the perimeter of the top cap.

9. The top cap of claim 8 further comprising a plurality of ribs extending downward from a lower surface of the top cap opposing the upper support surface.

10. The top cap of claim 8 wherein the lower lip structure includes a first notch and a second notch spaced from the first notch along a first side of the top cap, and a first notch and a second notch spaced from the first notch along a second side of the top cap, wherein the notches facilitate use of a first and second fork tine to lift a stack of the top caps.

11. A top cap comprising:

an upper support surface having a generally rectangular outer perimeter, a first side, a second side opposing the first side, a first end and a second end opposing the first end, the upper support surface including:

a first structure configured to be able to support a pallet, the first structure including a first rectangular recess proximate the first side and extending from the first end to the second end, a second rectangular recess proximate the second side and extending from the first end to the second end, and a third rectangular recess between the first recess and the second recess and extending from the first side to the second side;

a second structure configured to be able to support a steel mesh container; and a third structure configured to be able to support a collapsible container having a plurality of feet, the third structure including an upwardly extending protrusion proximate a middle portion of the first recess, and an upward extending protraction proximate a middle portion of the second recess, having a first raised portion between the first recess and the third recess, and a second raised portion between the second recess and the third recess, and wherein the first raised portion and the second raised portion include channels for matting with lower structure of another transport system.

12. A top cap comprising:

an upper support surface having a generally rectangular outer perimeter, a first side, a second side opposing the first side, a first end and a second end opposing the first end, the upper support surface including:

a first structure configured to be able to support a pallet, the first structure including a first rectangular recess proximate the first side and extending from the first end to the second end, a second rectangular recess proximate the second side and extending from the first end to the second end, and a third rectangular recess between the first recess and the second recess and extending from the first side to the second side;

a second structure configured to be able to support a steel mesh container; and a third structure configured to be able to support a collapsible container having a plurality of feet, the third structure including an upwardly extending protrusion proximate a middle portion of the first recess, and an upward extending protraction proximate a middle portion of the second recess, wherein the upper lip structure has a double wall construction.

* * * * *